United States Patent [19]

Morrison et al.

[11] Patent Number: 4,828,513

[45] Date of Patent: May 9, 1989

[54] ELECTRICAL HOUSING ASSEMBLY FOR REMOVABLE PLACEMENT ON A TABLE TOP

[75] Inventors: Andrew I. Morrison, Setauket; Charles Rozier, New York; Robert Reuter, East Setauket, all of N.Y.

[73] Assignee: Knoll International, Inc., New York, N.Y.

[21] Appl. No.: 872,249

[22] Filed: Jun. 9, 1986

[51] Int. Cl.[4] ..... H01R 13/60

[52] U.S. Cl. ..... 439/527; 439/535; 312/223

[58] Field of Search ..... 339/119, 125, 126, 122; 312/194, 195, 223, 239; 174/48.53; 108/25, 50, 26, 150; 639/527, 535, 544, 559, 571; 248/56

[56] References Cited

U.S. PATENT DOCUMENTS

| | | | |
|---|---|---|---|
| 2,866,956 | 12/1958 | Miller et al. | 339/122 R X |
| 2,934,590 | 4/1960 | Thompson et al. | 174/53 |
| 3,783,175 | 1/1974 | Timmons | 312/223 X |
| 4,237,796 | 12/1980 | Gordon et al. | 312/239 |
| 4,273,957 | 6/1981 | Kolling | 174/53 X |
| 4,747,788 | 5/1988 | Byrne | 439/571 X |

*Primary Examiner*—Eugene F. Desmond
*Attorney, Agent, or Firm*—Thomas A. O'Rourke

[57] ABSTRACT

A furniture work surface such as a table top or desk top has a through hole in which is mounted a grommet. An electrical outlet box is insertable into the grommet without blocking the passage of the other wires that pass through the grommet to the work surface. The electrical housing has a recess which removably receives one of various receptacle modules, each receptacle module being configured to receive different circuits when fed by a multi-wire branch circuit.

10 Claims, 5 Drawing Sheets

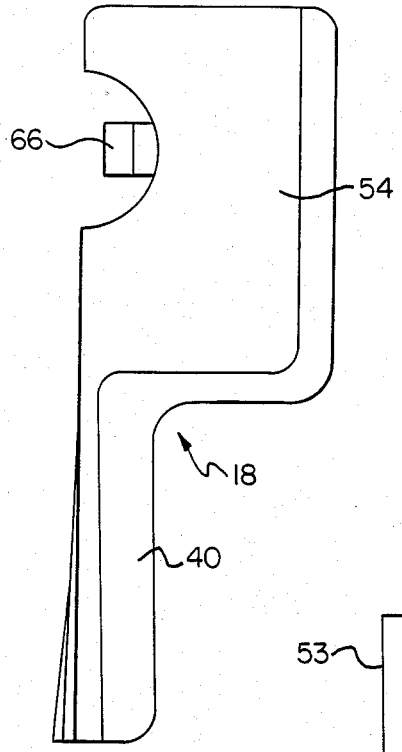
FIG.3
FIG.4
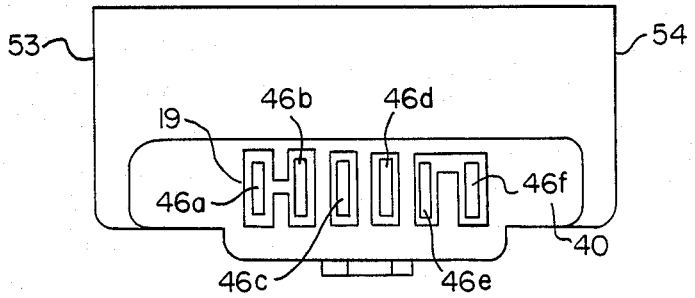
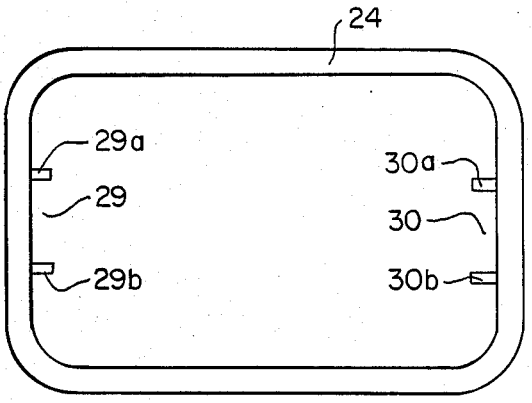
FIG.5

FIG.8
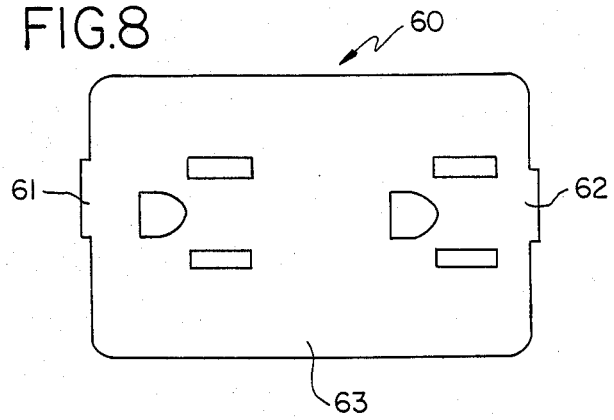
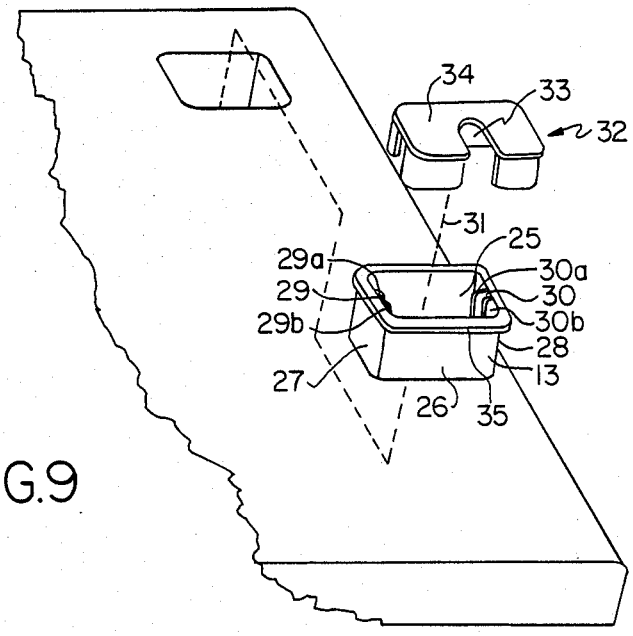
FIG.9

ELECTRICAL HOUSING ASSEMBLY FOR REMOVABLE PLACEMENT ON A TABLE TOP

BACKGROUND OF THE INVENTION

The present invention relates to electrical fixtures and more particularly to an electrical outlet box adapted to be mounted on a furniture work surface such as a table top or desk top.

Means for providing a power source to a work surface include providing a trough, channel or tray extending over a portion of the work surface with a hinged or removable cover in which an electric outlet, or outlets may be placed at different locations therein. Difficulties with power means employing a trough, channel or tray in the work surface occur particularly when the work surface has the employees' personal effects and work materials over the removable or hinged cover rendering the trough, channel or tray inaccessible so that it is not convenient to use the outlet.

It has also been suggested, in Reeves U.S. Pat. No. 2,271,463 that an electrical outlet box may be removably secured to the edge of an ironing board by a spring clip attachment. However, that type of spring clip device is not suitable for permanent installation on a desk or table as such an arrangement is merely a temporary power tap and does not meet the code requirements for permanent power distribution. In addition, this patent makes no provision for coping with the visual disarray of a work surface cluttered with wires.

A number of patents show floor outlet boxes which protrude above the level of the floor, such patents include Kelly, U.S. Pat. No. 3,395,243; Hudson, U.S. Pat. No. 2,907,813 and Dubreuil, U.S. Pat. No. 3,794,956.

OBJECTS AND FEATURES OF THE INVENTION

Modern office furniture today frequently is in the form of work stations having one or more holes on the surface to pass wire therethrough. These holes are frequently grommetted and are used to pass telephone wires, wires for computers, etc. through the work surface.

It is one of the objects of the present invention to provide an electrical fixture that may be inserted into these grommets or holes in the work surface and provide a multi-wire branch circuit to the work surface.

It is a feature of the present invention to provide a source of power to the work surface through the grommet or hole without blocking the other wires that of necessity must extend to the work surface through the grommet or hole such as telephone wires.

It is an object of the present invention to provide an electrical fixture that may be mounted in the grommet or hole in the form of a module that extends above the work surface and permits the remaining wires to extend from the grommet or hole.

Alternatively the electrical fixture of the present invention may be beneath the surface of the work surface and be attached to the grommet or hole in such a manner so as to permit the remaining wires to pass through the grommet or hole to the work surface.

It is a further object of the present invention to provide an electrical fixture for use with a grommet or a hole on the work surface that provides for concealment of wires such as by looping the extra length of wire through the grommet or hole when an appliance is connected to the electrical fixture of the present invention.

It is a further object of the present invention to integrate in a visually pleasing manner the means of mounting an outlet with the passing of wires through the work surface.

It is a further object of the present invention to provide a power distribution means that meets all the applicable code requirements for permanent power distribution.

It is an object of the present invention to provide an electrical outlet housing which may be removably attached in a grommetted opening or a hole configured to act as a grommet in the desk top, table top, or other work surface.

It is also an object of the present invention that when the outlet fixture box is removed, the pre-formed opening in the desk or table hole may be readily fitted with a removable cover or the opening may be used for a telephone jack outlet.

It is a further object of the present invention that the electrical housing is adapted to receive different alternative receptacle modules having various types of connectors, for example, configured to receive different circuits when fed by a multi-wire branch circuit. In addition, the receptacle module may have various other types of connectors such as 110-volt, two-prong with and without ground, or 220-volt three-prong, etc. The receptacle modules may be readily removed and replaced to accommodate varying power needs at the work station.

It is a further object of the present invention to provide an outlet electrical housing which may be moved to any of a number of preformed openings which may be on the work surface for the convenience of the user.

It is a feature of the present invention to provide an electrical fixture assembly for installation in a hole preferably rectangular but which can be any configuration in a furniture work surface, such as a table top or desk top. The fixture assembly includes a grommet which fits in the table or desk hole. The grommet or hole may be designed or fitted to receive the electrical housing.

The grommet preferably has an imaginary vertical axis and four opposite side walls substantially parallel to the grommet axis although other shapes are possible, an outwardly projecting flange which may adapted to bear on either the top or bottom surface of the work surface. The grommet may also have vertically aligned channels on the internal face of each of two opposite walls or other suitable means for receiving the electrical fixture assembly of the present invention.

The fixture assembly also includes an electrical housing adapted to partially fit in said grommet and protrude above the furniture work surface. In one embodiment the electrical housing may have a thin flat elongated portion whose opposite sides are removably slid in the channels and are removably retained therein. The electrical housing may be directly connected to the electrical cable or alternatively may have a first connector block at the thin portion of the electrical housing. The connector block may have a plurality of electrical contacts designed so there is no shock hazard and which may be adapted to be removably connected to a connector at the end of an electrical power cable. The electrical contacts may be for example, in the form of multi-contact male-female connection pairs or other suitable connectors.

In one embodiment, the first connector block may have its open face perpendicularly aligned relative to the axis although other configurations are possible. The electrical housing may also have a connector housing which may be formed by a top wall and bottom wall perpendicular to the axis and a back wall and two opposited side walls, which back and side walls may be, for example, parallel to the imaginary axis. However, it will be appreciated that other shapes are possible.

The electrical housing may also includes a second connector block having a plurality of electrical connectors spaced by insulative portions. In one embodiment, the second connector block may have a long axis that is parallel to the imaginary axis, the second connector block being fastened to the connector housing. Wire connection means within the electrical housing connect the contacts of the first connector block or cable to the contacts of the second connector block.

A removable receptacle module fits in the connector housing and has a connector means which may be in the form of a rear connector block with electrical contacts which removably fit, in male-female fashion, in the connectors in the electrical housing. The receptacle module may also have a connector means, on its front face, which may be a plurality of female connector openings having connectors therein such as, for example, 110-volt two prong with and without ground or 220-volt three prong, etc. The receptacle module has means to connect its female contacts or openings to its rear connector block connectors.

Alternatively, in place of a removable receptacle module, the receptacle module may be switchable so that the particular circuit desired may be selected by a switch means such as three position switch in the receptacle.

BRIEF DESCRIPTION OF THE DRAWINGS

Other objects and advantages of the present invention will be apparent from the following detailed description taken in conjunction with the accompanying drawings. In the drawings:

FIG. 3 is a side plan view of the fixture box;

FIG. 4 is a bottom plan view of the fixture box;

FIG. 5 is a top plan view of the grommet box;

FIG. 8 is a front plan view of the plate insert;

FIG. 9 is a perspective view of the grommet box and its cover.

DETAILED DESCRIPTION OF THE DRAWINGS

Figure 1:
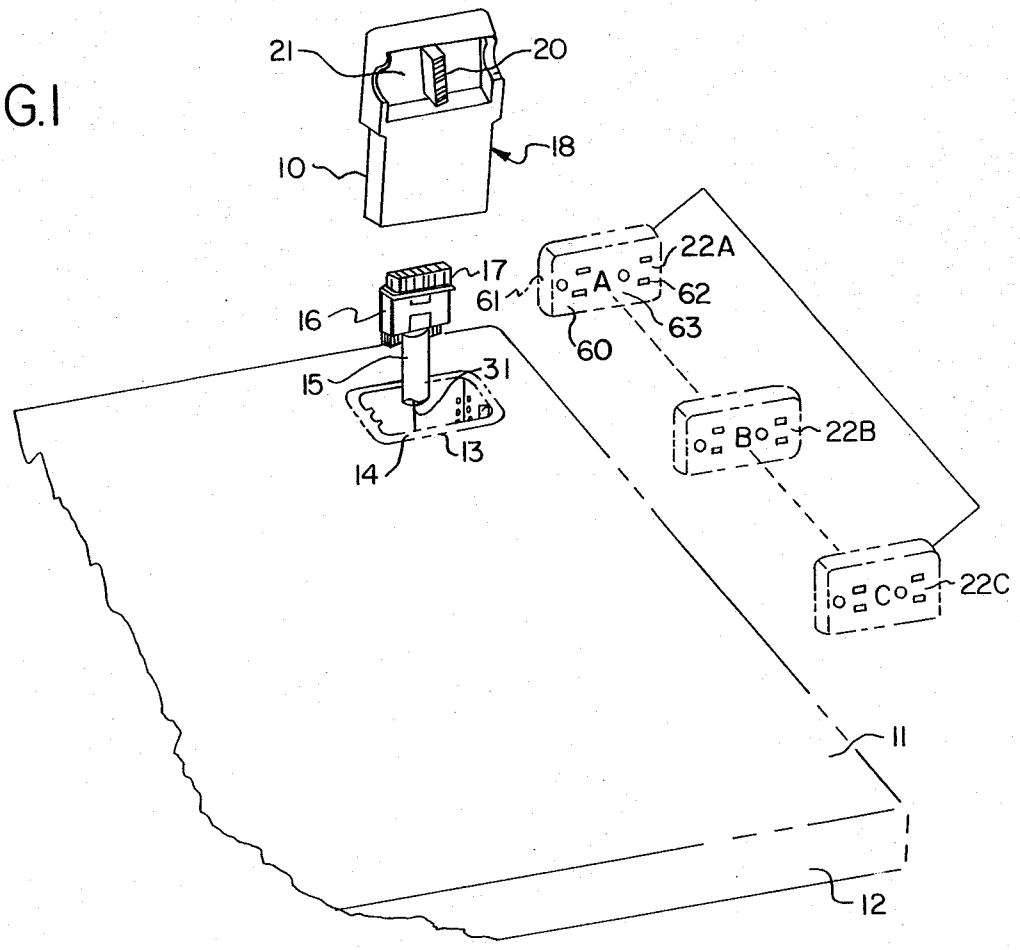
FIG. 1 is a perspective view showing the location of the electrical fixture assembly of the present invention on a furniture top.

As shown in FIG. 1, the electrical fixture assembly 10 of the present invention is adapted to be used on the top work surface 11 of furniture piece 12, such as a table top or a desk top.

A grommet 13 is inserted in a rectangular hole 14 through the furniture top work surface 11.

A cable 15 terminates in a connector block 16 having a plurality of female connecting members 17 protruding from the block 16.

An electrical housing 18 fits within the grommet 14. The electrical housing may fit within the grommet so that it can face either towards or away from the worker. The electrical housing 18 has a first connector block 19 internal at its bottom portion which mates with the connector block 16 at the end of the cable 15. A second connector block 20 in the recessed portion 21 of the electrical housing 18 is adapted to receive one of the alternative outlets in the form of the alternative removable receptacle module 22*a*, 22*b* or 22*c*.

Figure 6:
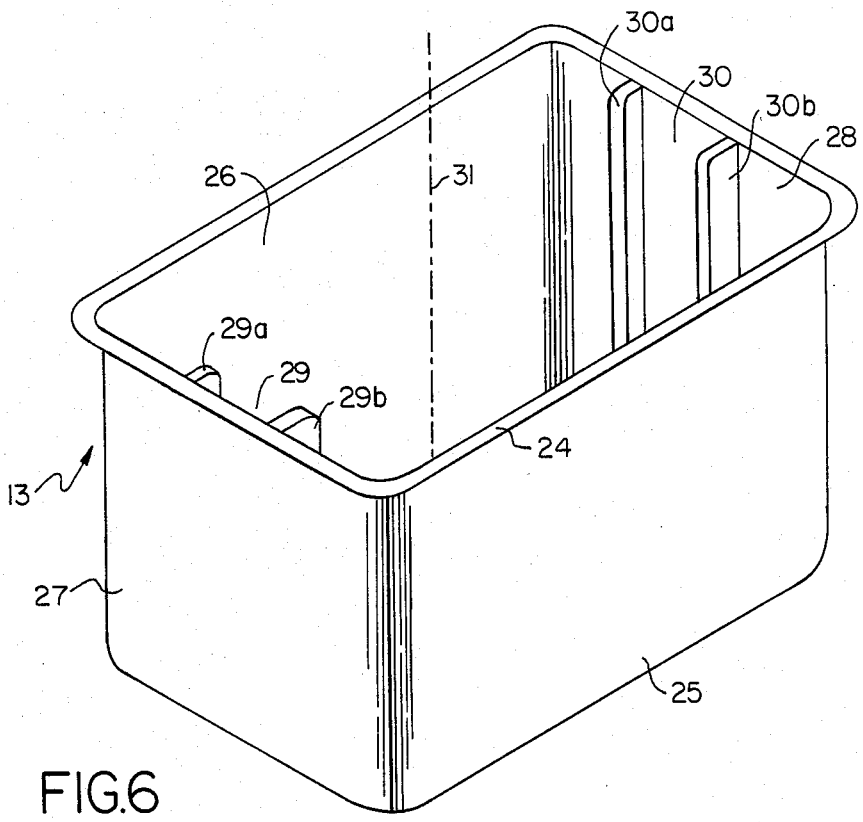
FIG. 6 is a perspective view of the grommet box.

As shown in FIG. 6, the grommet 13 consists of four sidewalls forming a rectangular box. The elongated sidewalls 25 and 26 are parallel to each other and opposite each other. Similarly, the short sidewalls 27 and 28 are parallel to each other and opposite each other.

Figure 2:
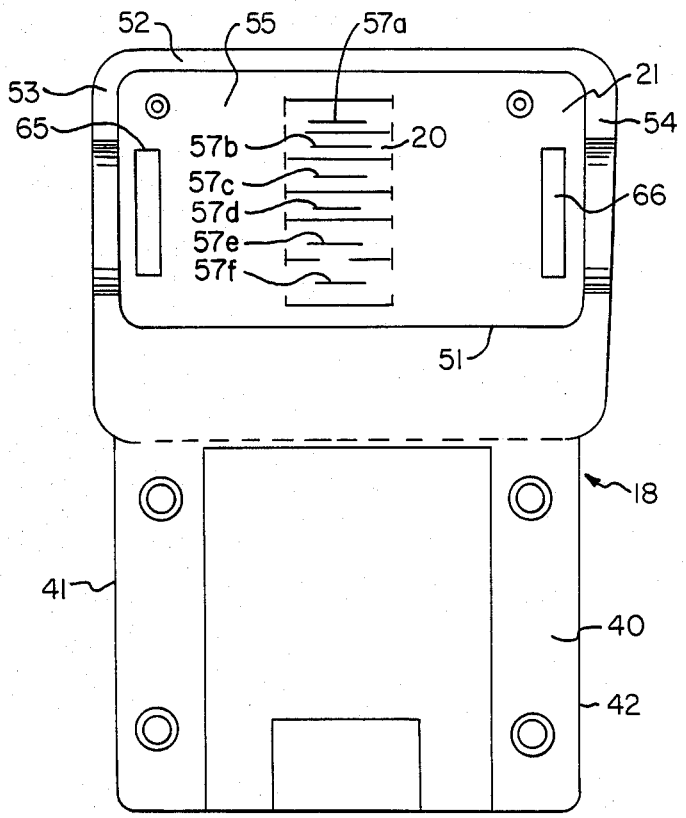
FIG. 2 is a front plan view of the fixture box.

A channel 29 is formed on the sidewall 27 by two vertically aligned elongated strips 29*a* and 29*b*. Similarly, a channel 30 is formed by the elongated strips 30*a* and 30*b* on the sidewall 28. The channels 29 and 30 are parallel to the imaginary central axis 31 of the grommet 13. The grommet 13 has an outer peripheral flange 24 whose bottom surface rests on the top surface of the furniture piece. If the grommet 13 is not to be used with an electrical housing 18, it may be covered by the cover member 32. The cover member 32 may have a elongated slit 33 in its top wall 34, permit telephone wires to be used in the grommet box in place of an electrical line. Alternatively, and not shown, the cover 32 may have the plain top wall 34 without the slit 33. As shown in FIGS. 2 through 4, the electrical housing 18 is adapted to partially fit within the grommet 13 and partially to protrude above the level of the grommet 13.

The electrical housing 18 has the thin body portion 40 which is rectangular viewed in cross-section perpendicular to the axis 31, see FIG. 2. The sidewalls 41,42 of the thin portion 40 may be removably slid in the channels 29 and 30 of the grommet 13. The bottom end of the thin body portion 40 terminates in a connector block 19 having a series of electrical connectors 46*a* through 46*f*, see FIG. 4. The connectors 46*a* through 46*f* are separated by insulative portions. The connectors 46*a*–4*f* are flat male connectors adapted to fit in the flat holes of the female connector 17.

The electric housing 18 at its top portion has the connector housing or recessed portion 21, see FIG. 2. The connector housing 21 is formed by bottom wall 51 and top wall 52, both of which are perpendicular to the axis 31. The connector housing is also formed by the two opposite sidewalls 53 and 54 and the back wall 55. The sidewalls 53 and 54 and the back wall 55 are parallel to the axis 31. A second connector block 20 is located within the connector housing and is fixed on the back wall 55. The second connector block 20 consists of flat male electrical connectors 57*a* through 57*f*, which are separated by insulative portions. The insulative portions of second connector block 20 like the first connector block, may be formed,.integrally with the body portion of the electrical housing. Preferably the electrical housing 18 is injection molded, in two members, from a suitable insulative plastic resin.

Figure 7:
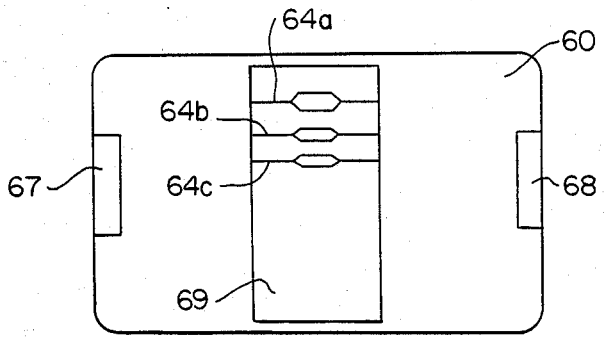
FIG. 7 is a rear plan view of the plate insert.

The removable receptacle module 60 is positioned within the connector housing 21 and may be removed therefrom. The receptacle module 60 has opposite integral plastic spring fingers 61 and 62 which spring into flexible flat protruding posts 65, 66, respectively, when the posts 65, 66 are inserted through the holes 67, 68, respectively, see FIGS. 2 and 7. The receptacle module 60 has on its front face 63 a plurality, electrical female contact openings and their respective contacts. For example, it may be a duplex outlet having two sets of openings. The rear side of the receptacle module 60, as shown in FIG. 7, includes projecting electrical contacts 64a through 64c which are in recess 69. These contacts 64a–64c are the male contacts which match the female contacts within the connector block 20.

The receptacle modules are readily changed by pressing inwardly on the spring fingers 61 and 62. They may be replaced by an alternative receptacle module which may have a different electrical configuration, for example, more or less outlets or outlets for a different voltage. In addition, whether or not the contacts are active depends upon the presence or absence of the metal contacts 64a–c as shown in FIG. 7. This provides the ability to change the voltage or the configuration of the electrical outlet by simply removing one receptacle module and replacing it with an alternative receptacle module.

In an alternative embodiment (not shown), switching means at the base of a desk or within the electrical housing are used to select the current going to the electric receptacle. The switching means eliminates the need to change the receptacle modules.

What is claimed is:

1. An electrical fixture assembly for installation in a grommet or hole in a table having a top surface, the fixture comprising:

an electrical housing adapted to partially fit in said grommet or hole and to protrude therefrom above said table top, said electrical housing having a thin flat elongated portion whose opposite sides are adapted to removably slide on channels within said grommet or hole and be removably retained therein, a first connector block at the bottom of said electrical housing and within the thin flat elongated portion and having a plurality of electrical connectors separated by insulation and adapted to be removably connected to a connector at the end of an electrical power cable, a connector module above said thin portion which is formed by a top wall and a bottom wall and a back wall and two opposite side walls;

a second elongated connector block having a plurality of spaced apart electrical connectors, the long axis of said second connector block being parallel to said axis, said second connector block being fastened to said connector module back wall, wire connection means within said electrical housing connecting the contacts of the first connector block to the contacts of the second connector block;

a removable receptacle module adapted to fit in said connector module and having a rear connector block with electrical contacts which removably fit in said connectors of said second connector block, said receptacle module having on its face a plurality of female connector openings having connectors therein, and means to connect said female connectors to said rear connector block connectors.

2. An electrical fixture assembly for installation in a grommet or hole in a furniture or work surface the fixture including:

an electrical housing for providing electrical power adapted to fit partially in a hole or grommet in a furniture work surface, said electrical housing being adapted to be removably slidable within said hole or grommet and removably retained therein, said electrical housing having a connector block having a plurality of spaced apart electrical connectors at the base of said electrical housing and said connector block being adapted to be removably connected to a connector at the end of an electrical power cable, said electrical housing permitting passage of wires through the remainder of the grommet or hole when said electrical fixture assembly is attached to said grommet or hole.

3. An electrical fixture assembly according to claim 2 wherein said electrical housing has a second connector block which is adapted to removably receive a receptacle module having a connector block with electrical contacts which removably fit in said connectors of said second connector block.

4. An electrical fixture assembly for installation in a grommet or hole in a furniture work surface the fixture comprising:

an electrical housing adapted to partially fit in said grommet or hole and said electrical housing being removably retained therein, a connector module within said electrical housing, a connector block having a plurality of spaced apart electrical connectors within said connector module, a removable receptacle module adapted to fit in said connector module and having a connector block with electrical contacts which removably fit in said connectors of said connector module.

5. An electrical fixture assembly according to claim 4 wherein said connector block is at the bottom of said electrical housing, and said connector block is adapted to be removably connected to a connector at the end of an electrical power cable.

6. An electrical fixture assembly according to claim 5 wherein said receptacle module has a plurality of female connector openings having connectors therein, and means to connect said female connectors to said connector block of the receptacle module.

7. An electrical fixture assembly for installation in a grommet or hole in a furniture work surface, the fixture comprising:

an electrical housing adapted to partially fit in said grommet or hole, said electrical housing being adapted to removably slide within said grommet or hole and being removably retained therein, a first connector block having a plurality of electrical connectors separated by insulation and adapted to be connected to an electrical power cable, a connector module within said electrical housing, a second connector block having a plurality of spaced apart electrical connectors, a wire connection means within said electrical housing connecting the contacts of the first connector block to the contacts of the second connector block;

a removable receptacle module adapted to fit in said connector module and having a connector block with electrical contacts which removably fit in said connectors of said second connector block.

8. An electrical fixture assembly for installation in a grommet or hole in a furniture work surface, the fixture comprising:

an electrical housing adapted to partially fit in a grommet or hole in a furniture work surface, a connector module within said electrical housing, a connector block having a plurality of spaced apart electrical connectors within said connector module, said connector block being at the bottom of said electrical housing and being adapted to removably connected to a connector at the end of an electrical power cable, a removable receptacle module adapted to fit in said connector module and having a connector block with electrical contacts which removably fit in said connectors of said connector module and wherein said receptacle module has a plurality of female connector openings having connectors therein and means to connect said female connectors to said connector block of the receptacle module, said electrical housing having a thin flat elongated portion whose opposite sides are adapted to removably slide on channels in a grommet or hole on the work surface and be removably retained therein.

9. An electrical fixture assembly according to claim 8 wherein said connector module is formed by a top wall and a bottom wall substantially horizontal and a back wall and two opposite side walls, said back and side walls being substantially vertical.

10. An electrical fixture assembly for installation in a grommet or hole in a furniture or work surface the fixture including:

an electrical housing for providing electrical power adapted to fit partially in to a hole or grommet in a furniture work surface, said electrical housing being adapted to be removably slidable within said hole or grommet and removably retained therein, said electrical housing having a connector block having a plurality of spaced apart electrical connectors within said housing, a removable receptacle module adapted to fit in said electrical housing and having a connector block with electrical contacts which removably fit in said connectors of said connector block, said electrical housing permitting passage of wires through the remainder of the grommet or hole when said electrical fixture assembly is attached to said grommet or hole.

* * * * *